United States Patent [19]

Irimajiri et al.

[11] 4,256,068

[45] Mar. 17, 1981

[54] OBLONG PISTON AND CYLINDER FOR INTERNAL COMBUSTION ENGINE

[75] Inventors: Shoichiro Irimajiri, Kawagoe; Takeo Fukui, Tokyo, both of Japan

[73] Assignee: Honda Giken Kogyo Kabushiki Kaisha, Tokyo, Japan

[21] Appl. No.: 91,837

[22] Filed: Nov. 6, 1979

Related U.S. Application Data

[63] Continuation-in-part of Ser. No. 022,942, Mar. 22, 1979, abandoned.

[30] Foreign Application Priority Data

Mar. 28, 1978 [JP] Japan ..... 53-34842

[51] Int. Cl.[3] ..... F02F 3/28; F02B 15/00; F02P 15/02

[52] U.S. Cl. ..... 123/193 P; 123/432; 123/636; 92/177

[58] Field of Search ..... 123/191 R, 193 P, 197, 123/148 C, 148 DS, 432, 636, 638; 92/177

[56] References Cited

U.S. PATENT DOCUMENTS

| | | | |
|---|---|---|---|
| 2,257,417 | 9/1941 | Kelly | 92/177 |
| 2,409,555 | 10/1946 | Gadoux et al. | 92/177 |
| 2,481,890 | 9/1949 | Toews | 123/148 C |
| 4,133,330 | 1/1979 | Nakajima et al. | 123/148 DS |

FOREIGN PATENT DOCUMENTS

| | | | |
|---|---|---|---|
| 142516 | 5/1920 | United Kingdom . | |
| 211192 | 2/1924 | United Kingdom . | |
| 469883 | 8/1930 | United Kingdom . | |
| 687528 | 2/1953 | United Kingdom | 123/191 M |
| 1049727 | 11/1966 | United Kingdom . | |
| 1177260 | 7/1970 | United Kingdom . | |
| 1388904 | 3/1975 | United Kingdom . | |

OTHER PUBLICATIONS

Insley; Investigation of the Effects on Cylinder Performance of Variation of Position and Number of Spark Plugs, Feb. 15, 1923, Air Service Information Circular, vol. 5, No. 401.

*Primary Examiner*—Craig R. Feinberg
*Attorney, Agent, or Firm*—Lyon & Lyon

[57] ABSTRACT

A four cylinder four cycle spark ignition engine has oblong pistons each mounted to reciprocate in sliding contact with an oblong cylinder. Intake valves in a series are positioned in a straight line on one side of and parallel to a central plane extending through the longest dimension of each oblong cylinder. Exhaust valves in a series are positioned in a straight line on the other side of and parallel to that central plane. A cam shaft operates all of the intake valves and another cam shaft operates all of the exhaust valves.

9 Claims, 9 Drawing Figures

10
26
28
30
35
36
38

10
11
12
13
14
15
16
17
21
23
23a
24
25
26
27
28
29
30
31
32
33
34
35
36
37
38

OBLONG PISTON AND CYLINDER FOR INTERNAL COMBUSTION ENGINE

This application is a Continuation-in-Part of Irimajiri and Fukui Ser. No. 22,942 filed Mar. 22, 1979 for Oblong Piston and Cylinder for Internal Combustion Engine, now abandoned.

This invention relates to internal combustion engines and is particularly directed to improvements which include oblong pistons mounted to reciprocate in sliding contact with oblong cylinders, for the purpose of producing a high speed engine having a high horsepower output. In order to improve the horsepower output for each liter of displacement, it has been proposed to increase the maximum engine speed of revolution. However, there are certain disadvantages in this approach. First, in the range of high revolution speeds, as the engine speed increases the volumetric efficiency falls off. In order to increase the engine speed while maintaining volumetric efficiency at a certain value, it is necessary for the cylinder to be provided with fresh charges of air in an amount proportional to the engine speed of revolution. However, it is known that the velocity of air no longer increases when it reaches about 0.5 mach, and consequently the volumetric efficiency begins to decrease. In order to obtain higher values for volumetric efficiency, therefore, it is necessary to enlarge the effective opening area of the intake valves. Factors affecting the effective opening area of the intake valves include peripheral length, number of the intake valves, and lift of the intake valves.

Another difficulty with increasing the speed of engine revolutions is that the valve operating mechanism becomes unreliable. When the engine speed exceeds a maximum speed range, difficulties are encountered with valve jump, valve bounce, etc. The critical speed of revolution at which such phenomena occur is generally proportional to the square root of the valve spring force, and is inversely proportional to the square root of the least acceleration of the valve. The maximum speed of revolution is limited to that which is determined by these factors.

Furthermore, the upper limit of the engine speed of revolution is soon reached, because the inertia load of the reciprocating parts moving with the piston, connected rod, etc., is proportional to the square of the speed of revolution. Mechanical looses increase abruptly in the range of high speeds.

In order to overcome these problems encountered with high engine speeds, short strokes have been proposed, but there exists a critical range for shorter strokes in order to maintain an effective compression ratio and a combustion chamber configuration on an established displacement. Another proposal for improving power performance has been to improve combustion efficiency, achieved by increasing the compression ratio. However, an excessively high compression ratio produces pre-ignition or knocking. Known characteristics peculiar to fuel, combustion chamber configuration, and ignition timing permit only small increases in performance, and further substantial improvement in performance is not to be expected. Accordingly, proposals for shorter strokes and raised compression ratios have not resulted in significant improvements in performance.

In accordance with this invention, an improvement in volumetric efficiency is relied upon to obtain a substantial rise in engine performance, and more particularly to improve the power performance of conventional four cycle gasoline-powered internal combustion engines. Since the maximum volumetric efficiency is controlled by the effective opening area of the intake valves, it is necessary to raise the ratio of the effective opening area of the intake valves to a unit cylinder bore area. It has been known that two intake valves per cylinder help to increase volumetric efficiency. Two intake valves per cylinder and two exhaust valves per cylinder increase the volumetric efficiency but the improvment is less than desired. However, more than two intake valves per circular cylinder has required a sophisticated and costly valve operating mechanism.

In order to raise the volumetric efficiency, $\eta_v$, in a four cycle internal combustion engine, the blow-down effect of the exhaust system must be utilized positively. This blow-down effect uses the action of the outflow inertia of the exhaust gases to cause an increase in the rate of mixture intake flowing through the intake valves. It is therefore important to position the plurality of intake valves in a group on one side of the combustion chamber and the plurality of exhaust valves in a group on the other side, as well as to locate the intake and exhaust valves near to each other. Furthermore, to make higher engine speeds possible, the intake valves are positioned in line and the exhaust valves are positioned in line. This enables a single cam shaft to operate all of the intake valves directly. Another cam shaft operates all of the exhaust valves directly. Moreover, when rocker arms are used, it is possible to employ a simple valve operating mechanism for operating a plurality of valves simultaneously.

The horsepower per liter coefficient designated $\alpha$ may be expressed by the following equation:

$$\alpha = \frac{\left(\begin{array}{c}\text{Number of intake valves}\\ \text{per cylinder}\end{array}\right) \times \left(\begin{array}{c}\text{Peripheral length of}\\ \text{intake valve}\end{array}\right)}{\begin{array}{c}\text{Diameter of true circle equivalent to bore area of}\\ \text{each cylinder}\end{array}}$$

where the maximum valve lift has generally no bearing on the number of valves and is excluded from $\alpha$ in order to employ a constant value. Also, for the purpose of making $\alpha$ dimensionless, the deonominator is assumed to be the diameter of a true circle equivalent to the bore area.

Now, on the basis of the foregoing, it is assumed that "n" each of intake and exhaust valves are arranged respectively in line with the long axis of the oblong cylinder, placed at an angle of $\theta$ degrees in reference to the longitudinal centerline of the cylinder. First, in the case of a circular bore cylinder:

the intake valve diameter is assumed to be $dv_s$, the exhaust valve diameter $dv_e$ becomes $dv_e = 0.9\ dv_s$ This is a well-known, most desirable value.

The bore diameter $d_B$ is obtained from the following equation:

$$d_B = \left(\sqrt{(n-1)^2 + 0.9\cos^2\theta + 1}\right) dv_s$$

Therefore, from the above equations, the horsepower per liter coefficient $\alpha$ in the circular bore is:

$$\alpha = \frac{n\pi}{\sqrt{(n-1)^2 + 0.9\cos^2\theta} + 1.}$$

Next, in the case of an oblong (elliptical) bore cylinder, the diameter of a true circle equivalent to an elliptical bore area is obtained from the following equation:

(a) When n=1

$$d_B = 1.49 \cos\theta d v_s$$

(b) When n≧2

$$d_B = \sqrt{\frac{7.6(n-1)}{\pi}\cos\theta + 2.84\cos^2\theta}\ d v_s$$

Therefore, from the above equations, the horsepower per liter coefficient $\alpha$ in the oblong (elliptical) bore is:

(a) When the number of valves n=1

$$\alpha = \pi / 1.49 \cos\theta$$

(b) When n→2

$$\alpha = \frac{n\pi}{\sqrt{\frac{7.6(n-1)}{\pi}\cos\theta + 2.84\cos^2\theta}}$$

FIG. 6 shows this $\alpha$ obtained in accordance with various valve arrangements. According to this FIG. 6, when n>2, as compared with what is considered the best in conventional circular bores, $\alpha$ in elliptical bores is substantially higher.

A substantial improvment in the horsepower per liter ratio $\alpha$ is thus achieved.

Other and more detailed objects and advantages will appear hereinafter.

Figure 6:
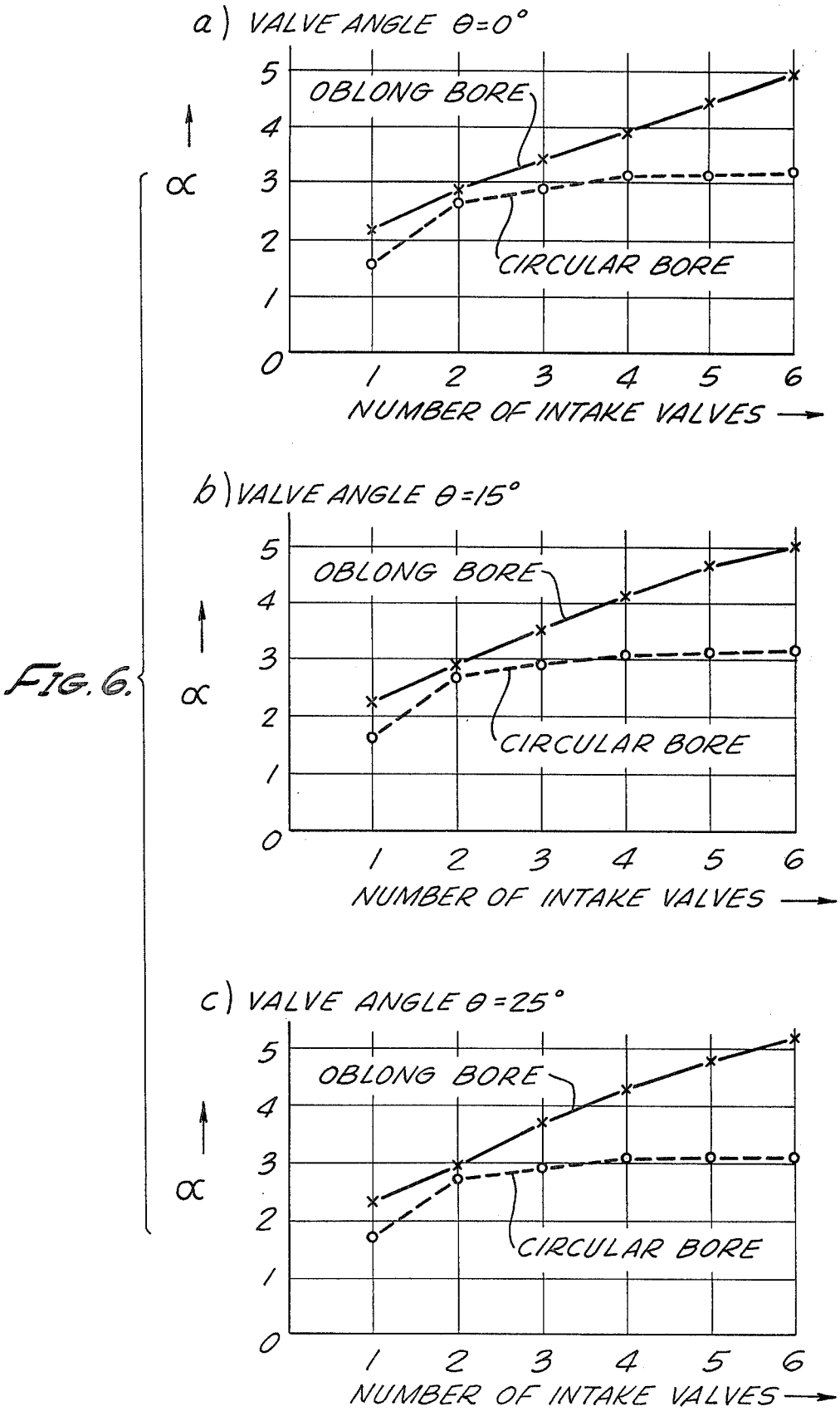

FIG. 6 is a series of three charts showing relationship of the horesepower-per-liter coefficient $\alpha$ to the number of intake valves per cylinder, for three different valve angles, $\theta=0$ degrees, $\theta=15$ degrees, and $\theta=25$ degrees, each graph showing an oblong bore in comparison with a circular bore. The angle $\theta$ is one-half the angle between two planes; one plane contains the axes of the intake valves and the other contains the axes of the exhaust valves.

Figures 3, 4:
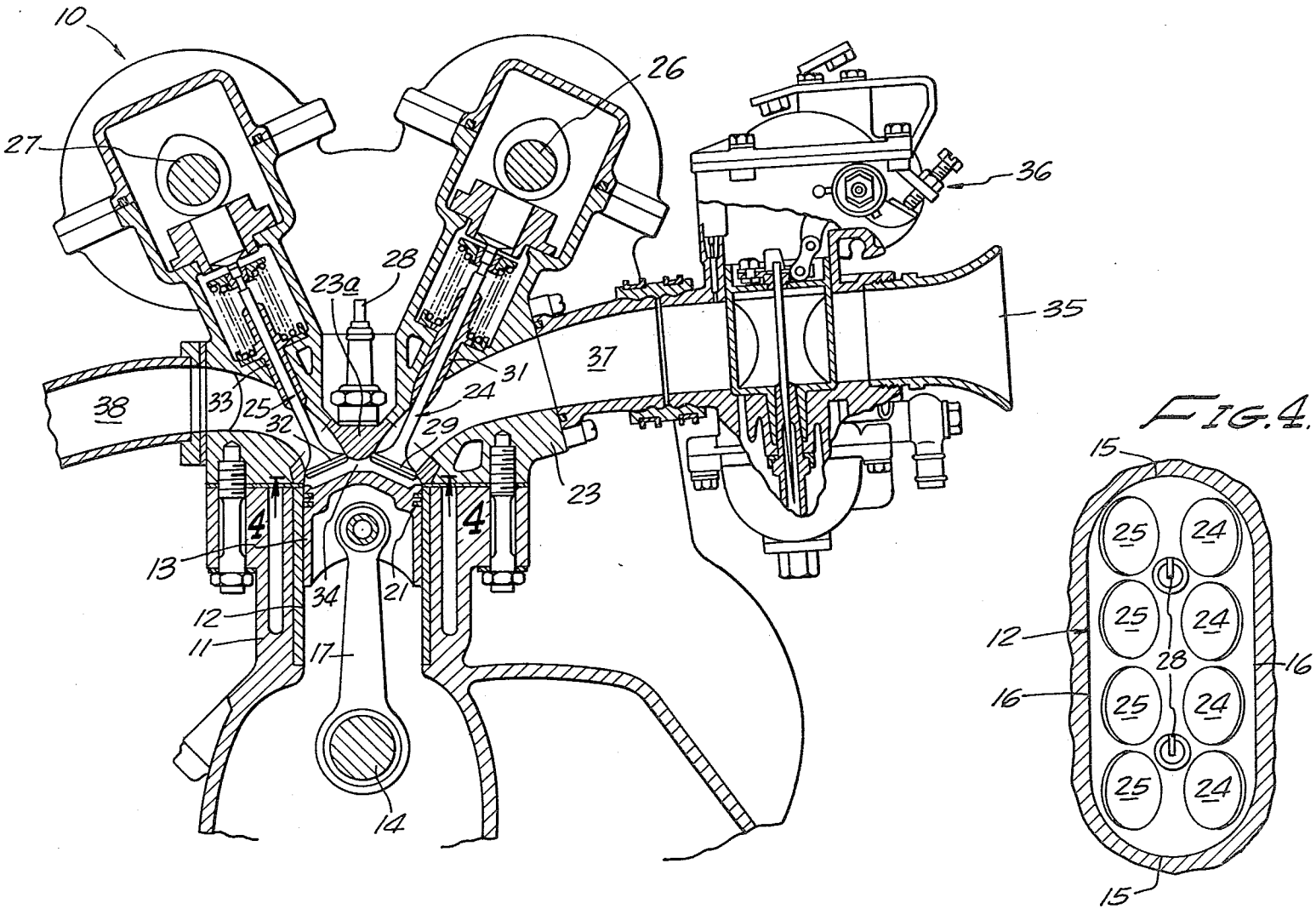
FIG. 3 is a sectional end elevation.
FIG. 4 is an underneath view taken substantially on the lines 4—4 as shown on FIG. 3.
Figure 7:
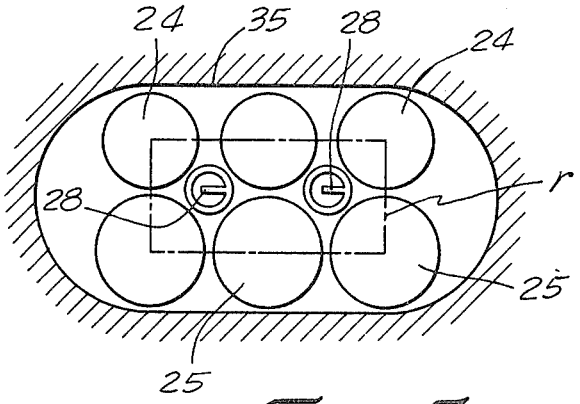

FIG. 7 is a schematic view similar to FIG. 4 showing a modification employing three intake valves and three exhaust valves.

Figure 8:
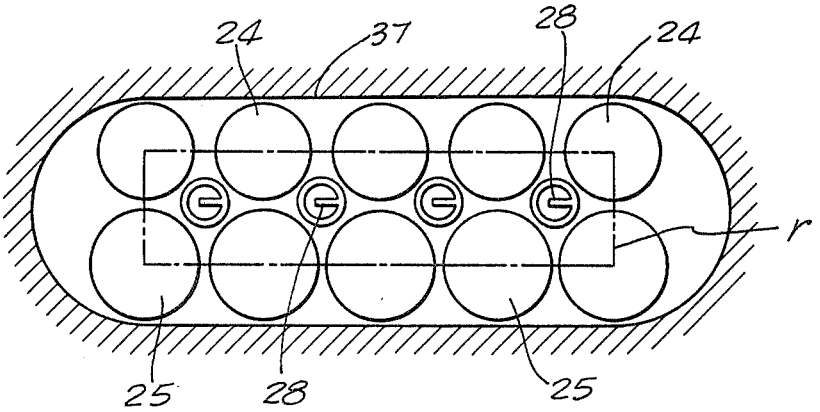

FIG. 8 is a schematic view similar to FIG. 4 showing another modification employing five intake valves and five exhaust valves.

Figure 9:
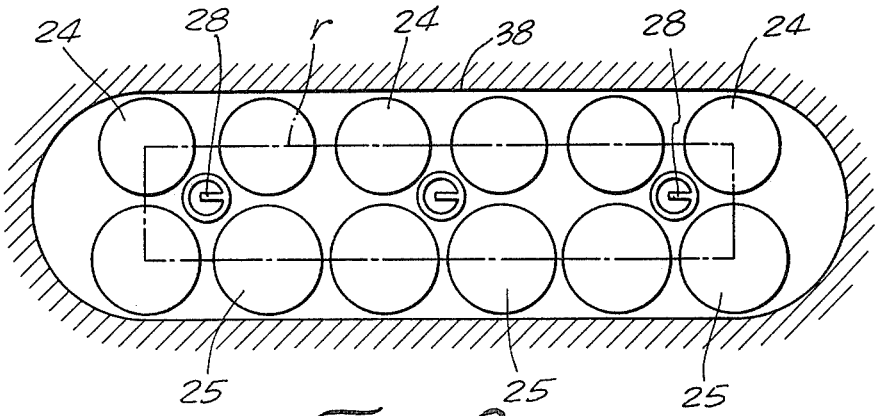
Figure 5:
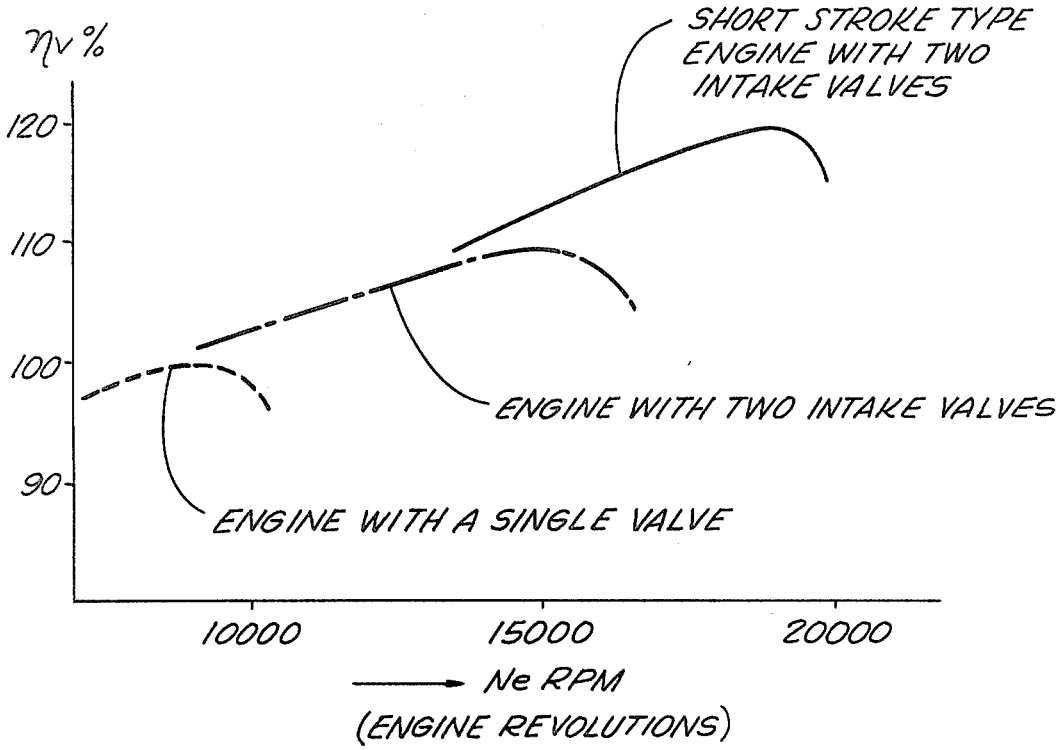
FIG. 5 is a graph showing the relation of volumetric efficiency to engine RPM, for engines of different numbers of intake valves per cylinder.

FIG. 9 is a schematic view similar to FIG. 4 showing another modification employing six intake valves and six exhaust valves.

Figure 1:
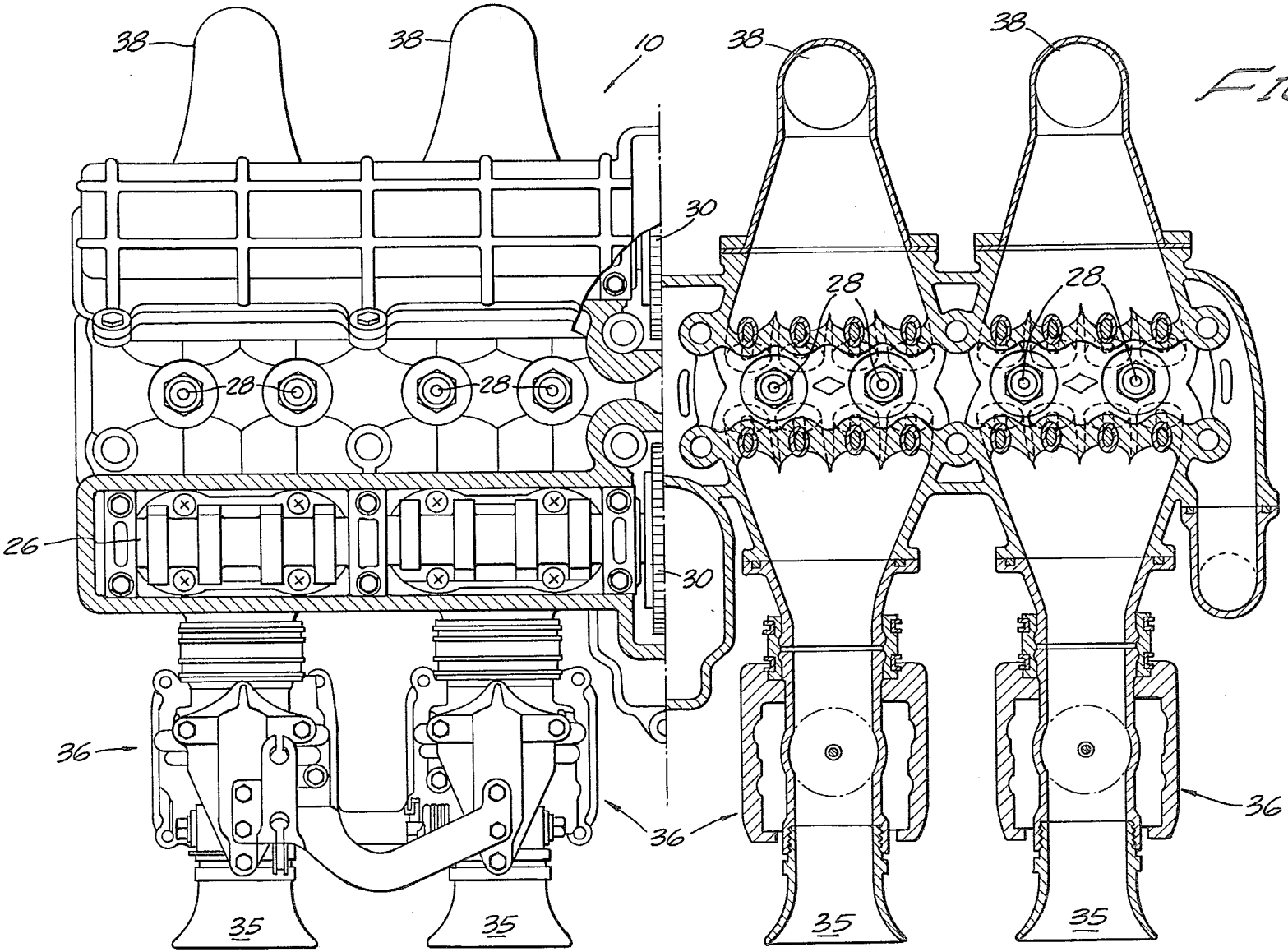
FIG. 1 is a plan view partly in section showing a four cylinder internal combustion engine constituting a preferred embodiment of this invention.
Figure 2:
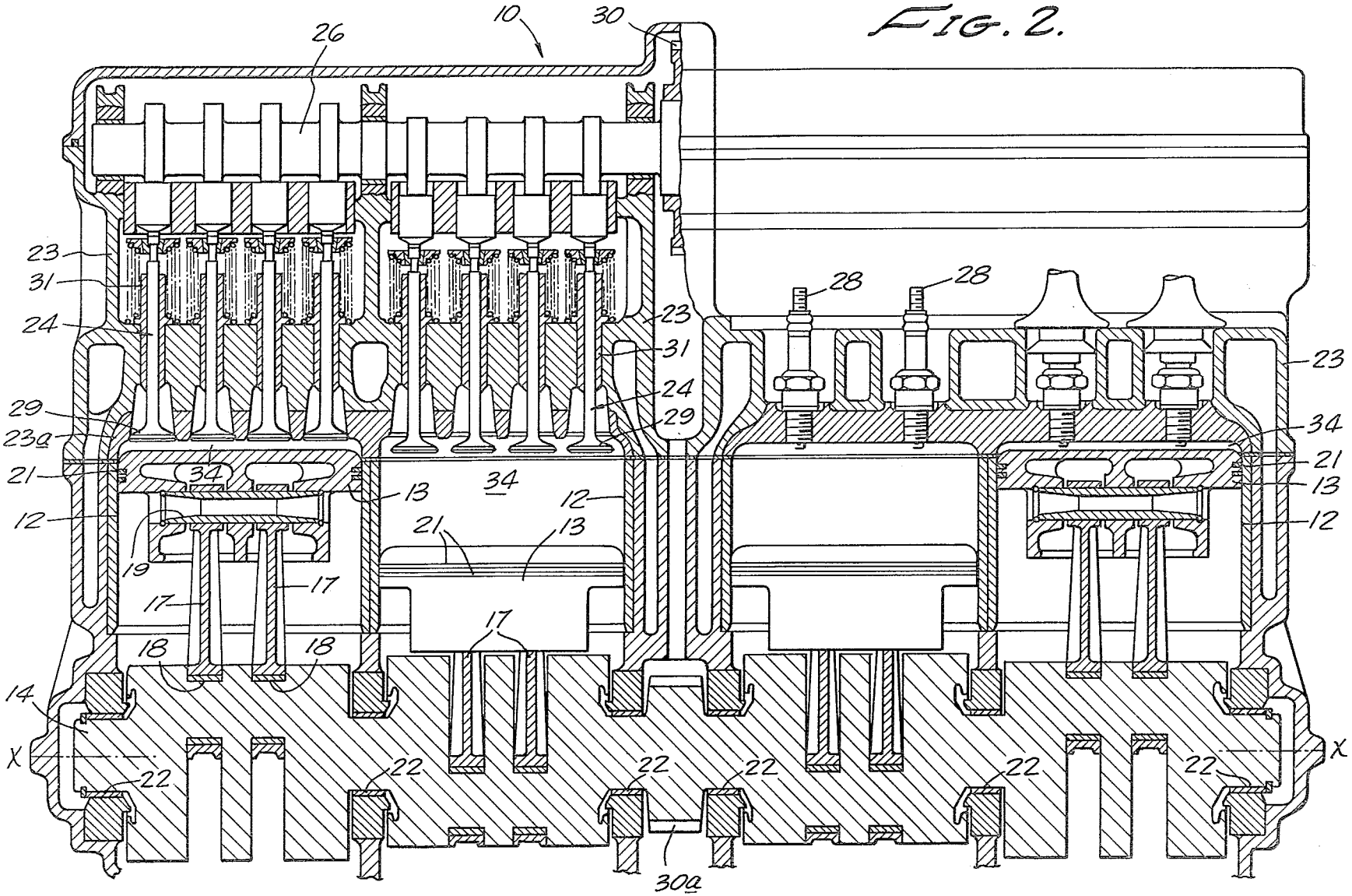
FIG. 2 is a sectional side elevation.

Referring to the drawings, the engine generally designated 10 has a body 11 provided with four parallel upright cylinders 12. A piston 13 reciprocates in each of the cylinders 12 but the cooperating sliding surfaces of each piston and cylinder are not cylindrical. Instead, each piston and cylinder is elongated in a direction parallel to the rotary axis X—X of the crankshaft 14, as shown in FIG. 2.

As best shown in FIG. 4, each cylinder 12 is oblong, that is, having a greater dimension in one direction than in another direction at right angles thereto. The cylinder 12 preferably has curved ends 15 which each constitute a part of a circle, in cross section, these curved ends 15 being joined by side surfaces 16 which are preferably in the form of parallel planes. However, the side surfaces 16 may be arched to increase the lateral dimension of the cylinder, or the cross section of the cylinder may be in the form of an ellipse. It is intended that the term "oblong" cover any of these shapes. Each cylinder 12 is symmetrical about a plane passing through the longest of the cylinder cross sections.

Two duplicate connecting rods 17 connect each piston 13 to crank throws 18 formed on the crankshaft 14. Each connecting rod 17 has a portion encircling the pin 19 mounted in the piston 13 and extending in a direction parallel to the axis X—X of the crankshaft 14. Piston rings 21 seal the sliding contact between each piston 13 and its respective cylinder 12. The crankshaft 14 is supported in the body 11 by means of a series of axially spaced bearings 22.

The engine head 23 is provided with stationary liners **23*a* each having a plurality of seats for intake valves 24 and exhaust valves 25. The intake valves 24 are arranged in a straight line so that they may be operated by a single cam shaft 26. Similarly, the exhaust valves 25 are arranged in a straight line so that they may be operated by a single cam shaft 27. A ribbed pulley 30*a* on the crankshaft 14 drives ribbed pulleys 30 on each of the cam shafts 26 and 27 by means of one or more timing belts or gears, not shown. Two sparkplugs 28 are provided for each cylinder and these are symmetrically positioned with respect to the intake valves 24 and exhaust valves 25**.

Each inlet valve 24 has a valve head 29 and a valve stem slidable in a guide 31 mounted in the stationary head 23. Each exhaust valve 25 has a valve head 32 and a stem slidably mounted within a guide 33 mounted on the stationary head 23. Each valve head 29 and 32 is positioned within a combustion chamber 34 defined between the walls of the cylinder 12, the stationary liner **23*a*, and the piston 13**.

In the modified form of the invention shown in FIG. 7, three intake valves 24 are positioned in a straight line on one side of and parallel to a central plane extending through the longest dimension of the oblong cylinder 35. Three exhaust valves 25 are positioned in a straight line on the other side of and parallel to said plane. Two sparkplugs 28 are employed and positioned symmetrically within the region bounded by the lines "r" joining the centers of the intake valves and exhaust valves.

In the modified form of the invention shown in FIG. 8, five intake valves 24 are positioned in a straight line on one side of and parallel to a central plane extending through the longest dimension of the oblong cylinder 37. Five exhaust valves 25 are positioned in a straight line on the other side of and parallel to said plane. Four sparkplugs 28 are symmetrically positioned within a region bounded by the lines "r" connecting the centers of the intake valves and exhaust valves.

In the modified form of the invention shown in FIG. 9, six intake valves 24 are positioned in a straight line on one side of and parallel to a central plane extending through the longest dimension of the oblong cylinder 38. Six exhaust valves 25 are positioned in a straight line on the other side of and paralel to said plane. Three sparkplugs 28 are employed and are symmetrically positioned within the region bounded by the lines "r" which join the centers of the intake valves and the exhaust valves.

In operation, air enters the intake ducts 35, passes through the individual carburetors 36, through the intake passages 37, past the intake valves 24 and into the combustion chambers 34. Following the compression stroke of each piston 13 the sparkplugs 28 ignite the compressed mixture to move the pistons 13 and to cause the connecting rods 17 to turn the crankshaft 14. The exhaust valves 25 open to permit burned exhaust gases to escape through the exhaust passages 38.

Having fully described our invention, it is to be understood that we are not to be limited to the details herein set forth but that our invention is of the full scope of the appended claims.

We claim:

1. In an internal combustion engine, the combination of: stationary walls forming an oblong cylinder, an oblong piston slidably mounted to reciprocate in sliding contact within said cylinder, said walls and piston cooperating to form a combustion chamber, a series of more than two intake valves positioned on a first side of a central plane extending through the longest dimension of said oblong cylinder in a substantially straight line on said first side of and parallel to said plane, a series of more than two exhaust valves positioned on the second side of said plane in a substantially straight line on said second side of and parallel to said plane, each of said valves having a valve head positioned in said combustion chamber and having a valve stem slidably mounted in said stationary walls, and a crankshaft, said crankshaft being parallel to said central plane.

2. In an internal combustion engine, the combination of: stationary walls forming an oblong cylinder, an oblong piston slidably mounted to reciprocate in sliding contact within said cylinder, said walls and piston cooperating to form a combustion chamber, a series of more than two intake valves positioned on a first side of a central plane extending through the longest dimension of said oblong cylinder in a substantially straight line on said first side of and parallel to said plane, a series of more than two exhaust valves positioned on the second side of said plane in a substantially straight line on said second side of and parallel to said plane, each of said valves having a valve head positioned in said combustion chamber and having a valve stem slideably mounted in said stationary walls, and a crankshaft, said crankshaft being parallel to said central plane, the number of said intake valves and the number of said exhaust valves being equal and each said intake valve being paired with a said exhaust valve such that each said pair is positioned in a straight line substantially perpendicular to said central plane.

3. The combination set forth in claim 2 in which there are an even number of said intake valves and in which there is a plurality of spark plugs wherein the number of said spark plugs is equal to one-half the number of intake valves, said spark plugs being positioned centrally between two said intake valves and two said exhaust valves.

4. The combination set forth in claim 2 in which there are an odd number of said intake valves and in which there is a plurality of spark plugs, the number of spark plugs being equal to one less than the number of intake valves, said spark plugs being positioned centrally between two said intake valves and two said exhaust valves.

5. The combination set forth in claim 1 or claim 2 in which a plurality of spark plugs is provided within a region which is enclosed by the lines connecting the centers of the outermost of said intake and exhaust valves.

6. The combination of claim 1 or claim 2 including a first cam to drive all of said intake valves and a second cam to drive all of said exhaust valves.

7. The combination set forth in claim 1 or claim 2 further including two connecting rods connecting said piston to said crankshaft.

8. The combination set forth in claim 1 or claim 2 including a plurality of said combustion chambers with substantially identical valve patterns.

9. The combination of claim 8 further including two connecting rods associated with each said piston.

* * * * *

UNITED STATES PATENT AND TRADEMARK OFFICE

CERTIFICATE OF CORRECTION

PATENT NO. : 4,256,068

DATED : March 17, 1981

INVENTOR(S) : Shoichiro Irimajiri et al

It is certified that error appears in the above—identified patent and that said Letters Patent is hereby corrected as shown below:

Column 3, line 24, should read:

(b) When $n \geqq 2$

Signed and Sealed this

*Thirtieth* Day of *June 1981*

[SEAL]

*Attest:*

RENE D. TEGTMEYER

*Attesting Officer*

*Acting Commissioner of Patents and Trademarks*